US006114020A

United States Patent [19]

Misuda et al.

[11] Patent Number: 6,114,020

[45] Date of Patent: Sep. 5, 2000

[54] RECORDING MEDIUM AND INK-JET RECORDING PROCESS USING THE RECORDING MEDIUM

[75] Inventors: Katsutoshi Misuda, Yokohama; Nobuyuki Hosoi, Kazo; Kenji Shinjo; Ako Omata, both of Kawasaki, all of Japan

[73] Assignee: Canon Kabushiki Kaisha, Tokyo, Japan

[21] Appl. No.: 09/025,252

[22] Filed: Feb. 18, 1998

[30] Foreign Application Priority Data

Feb. 18, 1997 [JP] Japan ..... 9-033814
Apr. 24, 1997 [JP] Japan ..... 9-107348

[51] Int. Cl.[7] ..... B41M 5/00; B41J 2/01

[52] U.S. Cl. ..... 428/212; 347/102; 347/105; 428/195; 428/206; 428/327

[58] Field of Search ..... 428/327, 328, 428/212, 195, 206; 347/105, 102

[56] References Cited

U.S. PATENT DOCUMENTS 4,242,271 12/1980 Weber et al. ..... 260/448 AD
5,027,131 6/1991 Hasegawa et al. ..... 428/327
5,411,787 5/1995 Kulkarni et al. ..... 428/327

FOREIGN PATENT DOCUMENTS

285145A2 10/1988 European Pat. Off. .
288193A2 10/1988 European Pat. Off. .
59-22683 2/1984 Japan .
59-222381 12/1984 Japan .
6-55870 3/1994 Japan .
7-237348 9/1995 Japan .
8-2090 1/1996 Japan .

*Primary Examiner*—Pamela R. Schwartz
*Attorney, Agent, or Firm*—Fitzpatrick, Cella, Harper & Scinto

[57] ABSTRACT

Disclosed herein is a recording medium comprising a base material and a porous surface layer containing particles of a thermoplastic resin, wherein the breadth of the particle size distribution of the particles of the thermoplastic resin is within 3σ, and the proportion of particles having a particle size at most a fifth of the average particle size of the particles of the thermoplastic resin is 10% or lower.

7 Claims, No Drawings

RECORDING MEDIUM AND INK-JET RECORDING PROCESS USING THE RECORDING MEDIUM

BACKGROUND OF THE INVENTION

1. Field of the Invention

The present invention relates to a recording medium and an ink-jet recording process using such a recording medium.

2. Related Background Art

An ink-jet recording system is a system wherein minute droplets of an ink are ejected from orifices to apply them to a recording medium such as paper, thereby making a record of images, characters and/or the like, has such features that recording can be conducted at high speed and with low noise, color images can be formed with ease, and development is unnecessary, and is hence developed into information instruments such as printers copying machines, word processors, facsimiles and plotters, so that it is rapidly widespread.

In recent years, high-performance digital cameras, digital video cameras and scanners have begun to be provided cheaply, and occasion to output image information obtained from such instruments by an ink-jet recording system has increased conjointly with the spread of personal computers. Therefore, there is a demand for outputting images comparable in quality with silver salt photographs and multi-color prints made by a plate-making system using an ink-jet system.

Improvements in recording apparatus and recording systems, such as speeding up and high definition of recording, and full-coloring of images, have thus been made, and recording media have also been required to have improved properties.

Under the foregoing circumstances, recording media are generally required to have the following properties:

(1) being able to quickly absorb inks and prevent more feathering than recording needs;

(2) being able to provide a print having a high optical density and achieve high coloring ability;

(3) being able to provide a print having excellent weather fastness; and (4) being able to provide a glossy image.

In order to satisfy such requirements, a wide variety of proposals has been made. For example, it is described in Japanese Patent Application Laid-Open No. 59-22683 that in order to provide a printing sheet having good ink absorbency and gloss, at least two thermoplastic resins different from each other in the lowest film-forming temperature are applied to a surface of a base material and dried to form a film, thereby causing cracks in the surface.

It is also described in Japanese Patent Application Laid-Open Nos. 59-222381, 6-55870, 7-237348 and 8-2090 that in order to improve the water fastness and weather fastness of images formed, a layer containing thermoplastic resin particles is provided as a surface layer to form the surface layer into a film after printing.

However, the particle size distribution of thermoplastic resin particles is generally broad and includes various particle sizes. When a porous layer is formed with the thermoplastic resin particles having such a broad particle size distribution, particles of small sizes fill in voids formed among particles of large sizes. Further, the small particles are softened at a temperature lower than the glass transition temperature (Tg) of the resin so long as the temperature is close to Tg because heat is more effectively applied to particles of smaller sizes, so that the voids are more closely filled with the small particles. Therefore, the ink-absorbing speed of the resultant recording medium is slowed. As a result, such a recording medium has undergone bleeding at boundaries between different colors, and caused color irregularity (beading).

In addition, the feathering rate of inks has become low, so that in some cases, blank areas may have been caused due to formation of printed dots relatively small in diameter and distortion of dots, and the quality of images formed may have become poor.

SUMMARY OF THE INVENTION

Accordingly, it is an object of the present invention to provide a novel recording medium which can solve the above-described problems involved in the prior art, and hence quickly absorbs inks, permits formation of dots having an optimum diameter and is suitable for use in providing a print having a high optical density, and an ink-jet recording process using this recording medium.

The above object can be achieved by the present invention described below.

According to the present invention, there is thus provided a recording medium comprising a base material and a porous surface layer containing particles of a thermoplastic resin, wherein the breadth of the particle size distribution of the resin particles is within 3σ, and the proportion of particles having a particle size at most a fifth of the average particle size of the resin particles is 10% or lower.

According to the present invention, there is also provided an ink-jet recording process comprising the steps of ejecting droplets of an ink to apply the droplets to the recording medium described above, and then optionally heating the recording medium.

DETAILED DESCRIPTION OF THE PREFERRED EMBODIMENTS

In the present invention, a porous layer containing particles of a thermoplastic resin is provided as a surface layer, whereby an ink applied reaches an underlying layer, for example, an ink-receiving layer or an ink-absorbent base material, through the porous layer to form an image thereon. When the porous surface layer is then made nonporous, a print having a high optical density and excellent weather fastness can be provided.

A feature of the recording medium according to the present invention is that there is provided as a surface layer a porous layer containing thermoplastic resin particles adjusted so as to have a breadth of particle size distribution within 3σ and include particles having a particle size at most a fifth of the average particle size of the resin particles in a proportion of 10% or lower. This permits the provision of a recording medium having good ink absorbency, so that an adequate feathering rate of dots can be achieved, and a high-quality image free of any blank area can be provided. Incidentally, the symbol "σ" means a standard deviation of the particle size distribution of the resin particles.

If the particle size distribution exceeds 3σ or the proportion of particles having a particle size at most a fifth of the average particle size of the resin particles exceeds 10%, particles of smaller sizes become closely present around particles of greater sizes and fill in voids formed among the particles of greater sizes, so that the ink absorbency of the resulting recording medium is impaired, and the quality of an image formed on such a recording medium hence becomes poor.

The average particle size of the thermoplastic resin particles used in the surface layer is preferably within a range of from 0.1 to 5.0 μm, more preferably from 0.2 to 3.0 μm, still more preferably from 0.2 to 2.0 μm.

If the average particle size of the thermoplastic resin particles is smaller than 0.1 μm, the absolute void volume of the surface layer containing the thermoplastic resin particles becomes small, and a part of the particles may begin to soften at a temperature lower than but close to the Tg of the thermoplastic resin and fill in the voids in some cases. As a result, there is a tendency for the resulting recording medium to be deteriorated in ink absorbency, resulting in the formation of a poor-quality image. If the average particle size exceeds 5 μm, the surface layer of the resulting recording medium may be difficult to be smoothed in some cases when the recording medium is treated so as to make the surface layer nonporous after printing on the recording medium. As a result, there is a tendency for the glossiness of the recording medium to be lowered.

In the present invention, the particle size distribution, standard deviation σ and average particle size of the resin particles are values respectively measured by means of a granulometer LS230 manufactured by Coulter Co. In the present invention, the breadth of particle size distribution is a breadth of particle size distribution as to particles present in a proportion of at least 0.5% when the particle size distribution is taken at a breadth of 10 nm.

The thermoplastic resin particles used in the present invention are preferably particles formed of a latex. Examples of the latex include latices of the vinyl chloride, vinylidene chloride, styrene, acrylic, urethane, polyester, ethylene, SBR and NBR types.

In the case of polydisperse thermoplastic resin particles, where particles having a particle size at most a fifth of the average particle size of the resin particles are mixed in excess, the thermoplastic resin particles can be treated by centrifugation or separation by filtration, thereby adjusting the particle size of the thermoplastic resin particles within the above range.

The surface layer containing such thermoplastic resin particles can be formed by coating a base material or an ink-receiving layer provided on the base material with a coating formulation prepared so as to contain the thermoplastic resin particles in a range of from 10 to 50% by weight in terms of solids.

The thickness of the coating film containing the thermoplastic resin particles must be controlled in such a degree that surface glossiness is imparted by the treatment after printing, the development of interference color is prevented, and it fully functions as a protective film, and so the coating formulation is preferably applied so as to provide a coating thickness of generally from 2 to 10 μm.

As the base material used in the present invention, any of transparent and opaque base materials may be used. Examples of usable base materials include various kinds of paper, such as wood free paper, medium-quality paper, art paper, bond paper and resin-coated paper, and films formed of a plastic such as polyethylene terephthalate, diacetate, triacetate, polycarbonate, polyethylene or polyacrylate. When an ink-receiving layer is formed with only the porous layer containing the thermoplastic resin particles, an ink-absorbent paper web or a porous resin film is preferably used as the base material.

When paper is used as the base material, it is particularly preferable that the surface of the base paper composed of a fibrous material is coated with barium sulfate to adjust the Bekk smoothness and whiteness of the surface to at least 400 seconds and at least 87%, respectively, because an image comparable in quality with a silver salt photograph can be obtained.

Barium sulfate used herein desirably has an average particle size ranging from 0.4 to 1.0 μm, preferably from 0.4 to 0.8 μm. When barium sulfate having an average particle size within such a range is used, the desired whiteness, glossiness and ability to absorb solvents in inks can be satisfied.

A binder for binding barium sulfate is preferably gelatin. Gelatin is used in a proportion of from 6 to 12 parts by weight per 100 parts by weight of barium sulfate.

The coating weight of barium sulfate on the base paper is preferably within a range of from 20 to 40 g/m$^2$ for the purpose of improving the ability to absorb solvents in inks and surface smoothness.

When the smoothness of the barium sulfate layer is too high, the base paper is liable to incur reduction in ink absorbency. Therefore, the smoothness of the barium sulfate layer is desirably controlled to 600 seconds or lower, more preferably 500 seconds or lower.

A more preferred embodiment of the recording medium according to the present invention is such that an ink-receiving layer containing a pigment is provided as an underlying layer to the surface layer.

The ink-receiving layer is a layer for absorbing and holding inks applied to the porous layer containing the thermoplastic resin particles to form an image and is a porous layer composed mainly of the pigment.

Examples of the pigment used include silica, calcium carbonate and alumina hydrate. Among these, alumina hydrate is particularly preferred from the viewpoints of dye-fixing ability and transparency.

The alumina hydrate can be prepared in accordance with any known process such as hydrolysis of an aluminum alkoxide or hydrolysis of sodium aluminate. The form thereof includes cilium, needle, plate, spindle and the like and is irrespective of orientation.

The alumina hydrate used in the present invention may be either an industrially marketed product or one prepared from starting materials. These alumina hydrates preferably have features that transparency, glossiness and dye-fixing ability are high, and more preferably that no cracking occurs upon formation of a film, and its coating property is good. Examples of industrially marked products include AS-2 and AS-3 (trade names, products of Catalysts & Chemicals Industries Co., Ltd.) and 520 (trade name, product of Nissan Chemical Industries, Ltd.).

The alumina hydrate is generally fine as demonstrated by its particle size of 1 μm or smaller and has excellent dispersibility, so that very good smoothness and glossiness can be imparted to the resulting recording medium.

A binder for binding the alumina hydrate may be freely selected from among water-soluble polymers. Preferable examples thereof include polyvinyl alcohol and modified products thereof, starch and modified products thereof, gelatin and modified products thereof, casein and modified products thereof, gum arabic, cellulose derivatives such as carboxymethyl cellulose, hydroxyethyl cellulose and hydroxypropylmethyl cellulose, latices of conjugated diene copolymers such as SBR, NBR and methyl methacrylate-butadiene copolymers, latices of functional group-modified polymers, latices of vinyl copolymers such as ethylene-vinyl acetate copolymers, polyvinyl pyrrolidone, homopolymers and copolymers of maleic anhydride, and polymers of acrylic esters. These binders may be used either singly or in any combination thereof.

A mixing ratio by weight of the alumina hydrate to the binder may be optionally selected from a range of preferably from 1:1 to 30:1, more preferably from 5:1 to 25:1. If the amount of the binder is less than the lower limit of the above range, the mechanical strength of the resulting ink-receiving layer may become insufficient in some cases, so that there is a tendency to cause cracking and dusting. If the amount is greater than the upper limit of the above range, the pore volume of the resulting ink-receiving layer is reduced, so that the ink absorbency of the ink-receiving layer may be lowered in some cases.

To a coating formulation for forming the ink-receiving layer, as needed, may be added a dispersing agent, thickener, pH adjustor, lubricant, flowability modifier, surfactant, anti-foaming agent, water-proofing agent, parting agent, optical whitening agent, ultraviolet absorbent, antioxidant and the like in addition to the alumina hydrate and the binder.

The coating weight of the alumina hydrate on the base material is preferably at least 10 g/m$^2$ for the purpose of imparting dye-fixing ability and smoothness to the resulting ink-receiving layer. When the base material has no ink absorbency, the coating weight is more preferably within a range of from 30 to 60 g/m$^2$. When the base material has ink absorbency, the coating weight is more preferably within a range of from 20 to 40 g/m$^2$.

No particular limitation is imposed on the coating and drying processes of the coating formulation. However, the alumina hydrate and the binder may be subjected to a calcining treatment as needed. When the calcining treatment is conducted, the crosslinking strength of the binder is increased, the mechanical strength of the resulting ink-receiving layer is enhanced, and moreover the surface gloss of the alumina hydrate layer (i.e., ink-receiving layer) is enhanced.

In the present invention, inks are applied to the recording medium to form an image, and the porous layer containing the thermoplastic resin particles as the surface layer is then made nonporous (transparent) as needed, thereby obtaining a print.

As a method for applying the inks, an ink-jet system wherein droplets of an ink are ejected is preferred. Of the many ink-jet systems, a bubble jet system wherein thermal energy is applied to an ink to form droplets of the ink, and the droplets are ejected from orifices, by which high-speed and high-definition. printing is feasible, is preferred.

As a method for making the porous layer containing the thermoplastic resin particles nonporous, a heat treatment is preferred. When the porous layer is subjected to such a treatment, an image formed on the recording medium is improved in weather fastness such as water fastness or light fastness, good gloss can be imparted to the image, and the resulting print can be stored over a long period of time.

A heating temperature at this time is preferably within a range of from 70 to 180° C. taking influence on the materials of the base material, ink-receiving layer and inks and surface properties after the treatment into consideration, though it varies also with treating time.

The present invention will hereinafter be described more specifically by the following examples. However, the present invention is not limited to these examples.

EXAMPLE 1

An aluminum alkoxide was prepared in accordance with the process described in U.S. Pat. No. 4,242,271. The aluminum alkoxide was hydrolyzed, and the resultant hydrolyzate was treated by the defloculation process, thereby synthesizing colloidal sol of alumina hydrate.

The colloidal sol of alumina hydrate was concentrated to obtain a solution containing 15% by weight of the alumina hydrate. On the other hand, polyvinyl alcohol (PVA117, trade name, product of Kuraray Co., Ltd.) was dissolved in ion-exchanged water to obtain a 10% by weight solution. These two solutions were mixed with each other in such a manner that a weight ratio of the alumina hydrate to the polyvinyl alcohol is 10:1 in terms of solids, and the resultant mixture was stirred to obtain a dispersion.

The dispersion was coated on a polyethylene terephthalate film by a die coating process to form a porous layer containing pseudo-boehmite. The thickness of the porous layer was about 40 $\mu$m.

Further, a latex of polyvinyl chloride (Tg: 81° C.) containing 15% of solids was subjected to a centrifuging treatment, and 40% of the resultant supernatant liquid was removed, thereby preparing a coating formulation composed mainly of resin particles adjusted so as to have an average particle size of 0.64 $\mu$m, a standard deviation $\sigma$ of 0.20 $\mu$m and a breadth of particle size distribution of 0.55 $\mu$m, and include particles having a particle size at most a fifth of the average particle size of the resin particles in a proportion of 1%. The thus-obtained coating formulation was applied to the porous layer by a bar coater and dried at 75° C. to form a porous resin layer having a thickness of about 5 $\mu$m, thereby obtaining a recording medium according to the present invention. The resin layer formed of the latex was observed through a scanning electron microscope (SEM). As a result, it was found that a great number of voids were formed.

After an image was then formed on the recording medium by means of an ink-jet printer (BJC 610JW, trade name, manufactured by Canon Inc.), the recording medium was heat-treated at 170° C. to make the resin layer formed of the latex nonporous, thereby obtaining a print.

The optical density and state of printed dots of the print, and the ink absorbency of the recording medium were evaluated. The results are shown in Table 1.

a) Optical density:

The optical density of the print was measured by means of a reflection densitometer, RD-918 (trade name, manufactured by Macbeth Co.).

b) State of printed dots:

Printed dots of the print were observed through an optical microscope. The state of printed dots of the print obtained in Example 1 was evaluated and ranked as A where the diameter of each dot was greater, and the dots were smoothly formed in a shape closer to a circle, or B where the diameter of each dot was smaller, and the shape of the dots was deformed, or the dots underwent color irregularity, when compared with the dots formed on the reference medium, which is the same recording medium as used in Example 1 except that the porous layer containing the thermoplastic resin particles was not included as the surface layer, respectively.

c) Ink absorbency:

The print was observed as to whether bleeding at boundaries between different colors and beading occurred or not, and the ink absorbency of the recording medium was ranked as A where neither bleeding nor beading occurred, or B where bleeding and/or beading occurred.

EXAMPLE 2

A recording medium and a print were produced in the same manner as in Example 1 except that the same latex as that used in Example 1 was treated by passage through a microfiltration membrane to prepare a coating formulation composed mainly of resin particles adjusted so as to have an average particle size of 0.58 μm, a standard deviation a of 0.24 μm and a breadth of particle size distribution of 0.64 μm, and include particles having a particle size at most a fifth of the average particle size of the resin particles in a proportion of 5%, and the coating formulation was used for the surface layer. The evaluation results thereof are shown in Table 1.

The resin layer formed of the latex was observed through the SEM. As a result, it was confirmed that a great number of voids were formed.

EXAMPLE 3

A coated paper web as a base material was made in the following manner:

A coating formulation was prepared by mixing 100 parts by weight of barium sulfate having an average particle size of 0.6 μm, which had been formed by allowing sodium sulfate to react with barium chloride, 10 parts by weight of gelatin, 3 parts by weight of polyethylene glycol and 0.4 part by weight of chrome alum. The coating formulation was applied to a base paper web having a basis weight of 150 g/m$^2$ and a Bekk smoothness of 340 seconds so as to provide a dry coating thickness of 20 μm, and the base paper web thus coated was supercalendered to obtain a base material having a surface smoothness of 405 seconds.

A recording medium according to the present invention was produced in the same manner as in Example 1 except that the thus-obtained base material was used, AS-3 (trade name, product of Catalysts & Chemicals Industries Co., Ltd.) was used in place of the alumina hydrate used in Example 1, and the thickness of the porous layer containing the alumina hydrate was changed to 26 μm.

A print was produced in the same manner as in Example 1 except that this recording medium was used. The evaluation results are shown in Table 1.

EXAMPLE 4

A general-purpose woodfree paper web (basis weight: 65 g/m$^2$) having a Stöckigt sizing degree of 35 seconds was used as a fibrous base material, and a coating formulation having the following composition was applied to the base material by a blade coater process so as to provide a dry coating weight of 5 g/m$^2$, and dried by the conventional method.

| | |
|---|---|
| Calcium carbonate (average particle diameter: 0.7 μm) | 100 parts by weight |
| Starch | 30 parts by weight |
| SBR latex | 10 parts by weight |
| Water | 300 parts by weight. |

The same latex as that used in Example 1 was subjected to a centrifuging treatment to prepare a coating formulation composed mainly of resin particles adjusted so as to have an average particle size of 1.20 μm, a standard deviation a of 0.45 μm and a breadth of particle size distribution of 1.33 μm, and include particles having a particle size at most a fifth of the average particle size of the resin particles in a proportion of 2%. This coating formulation was further applied to the film formed of the first-mentioned coating formulation and dried in the same manner as in Example 1 to form a porous resin layer, thereby obtaining a recording medium according to the present invention. The evaluation results are shown in Table 1.

The resin layer formed of the latex was observed through the SEM. As a result, it was confirmed that a great number of voids were formed.

Printing was conducted on the recording medium in the same manner as in Example 1. As a result, it was found that the recording medium had excellent ink absorbency.

EXAMPLE 5

A recording medium was produced in the same manner as in Example 1 except that the same latex as that used in Example 1 was subjected to a centrifuging treatment, and 30% of the resultant supernatant liquid was removed to prepare a coating formulation composed mainly of resin particles adjusted so as to have an average particle size of 0.55μm, a standard deviation a of 0.27 μm and a breadth of particle size distribution of 0.77 μm, and include particles having a particle size at most a fifth of the average particle size of the resin particles in a proportion of 10%, and the coating formulation was used for the surface layer. The resin layer formed of the latex was observed through the SEM. As a result, it was confirmed that a great number of voids were formed.

Printing was conducted on the recording medium in the same manner as in Example 1. The evaluation results are shown in Table 1.

Comparative Example 1

A recording medium was obtained in the same manner as in Example 1 except that a polyvinyl chloride latex (Tg: 81° C.; average particle size: 0.5 μm; proportion of particles having a particle size at most a fifth of the average particle size of solids in the latex: 15%) was used to form a surface layer having a thickness of about 7 μm.

The resin layer formed of the latex was observed through the SEM. As a result, it was found that particles were closely filled, and the number of voids was extremely few.

Printing was conducted on the recording medium in the same manner as in Example 1. The evaluation results are shown in Table 1.

According to the present invention, there are provided recording media which have good ink absorbency, permit formation of dots having the desired shape and size and are suitable for use in providing prints having a high optical density.

While the present invention has been described with respect to what are presently considered to be the preferred embodiments, it is to be understood that the invention is not limited to the disclosed embodiments. To the contrary, the invention is intended to cover various modifications and equivalent arrangements included within the spirit and scope of the appended claims. The scope of the following claims is to be accorded the broadest interpretation so as to encompass all such modifications and equivalent structures and functions.

TABLE 1

| | Ex. 1 | Ex. 2 | Ex. 3 | Ex. 4 | Ex. 5 | Comp. Ex. 1 |
|---|---|---|---|---|---|---|
| Density | | | | | | |
| (O.D.) | 2.0 | 2.0 | 2.0 | 1.8 | 2.0 | 1.8 |
| Black | 1.7 | 1.7 | 1.7 | 1.6 | 1.7 | 1.8 |
| Yellow | 2.2 | 2.2 | 2.2 | 2.0 | 2.2 | 2.2 |
| Magenta | 2.4 | 2.4 | 2.4 | 2.2 | 2.3 | 2.3 |
| Cyan | | | | | | |
| State of printed dots | A | A | A | A | A | B |
| Ink absorbency | A | A | A | A | A | B |

What is claimed is:

1. A recording medium comprising a base material, a porous surface layer, and a porous ink-receiving layer provided between the base material and the surface layer, said surface layer containing particles of a thermoplastic resin, wherein the breadth of the particle size distribution of the particles of the thermoplastic resin is within 3σ, and the proportion of particles having a particle size at most a fifth of the average particle size of the particles of the thermoplastic resin is 10% or lower.

2. The recording medium according to claim 1, wherein the ink-receiving layer contains an alumina hydrate.

3. The recording medium according to claim 1, wherein the thermoplastic resin particles are particles formed of a latex.

4. The recording medium according to claim 1, wherein the thermoplastic resin particles have an average particle size ranging from 0.1 to 5 μm.

5. The recording medium according to claim 4, wherein the thermoplastic resin particles have an average particle size ranging from 0.2 to 3 μm.

6. An ink-jet recording process comprising the step of ejecting droplets of an ink to apply the droplets to the recording medium according to claim 1.

7. An Ink-jet recording process comprising the steps of ejecting droplets of an ink to apply the droplets to the recording medium according to claim 1, and then heating the recording medium.

* * * * *

UNITED STATES PATENT AND TRADEMARK OFFICE

CERTIFICATE OF CORRECTION

PATENT NO. : 6,114,020

DATED : September 5, 2000

INVENTOR(S) : KATSUTOSHI MISUDA, ET AL.

It is certified that error appears in the above-identified patent and that said Letters Patent is hereby corrected as shown below:

COLUMN 5:

Line 48, "high-definition." should read --high-definition--.

Line 57, "influence on" should be deleted.

COLUMN 7:

Line 4, "a of" should read --σ of--.

Line 62, "a of" should read --σ of--.

COLUMN 8:

Line 22, "a of" should read --σ of--.

COLUMN 10:

Line 18, "Ink-jet" should read --ink-jet--.

Signed and Sealed this

Fifteenth Day of May, 2001

Nicholas P. Godici

*Attest:*

NICHOLAS P. GODICI

*Attesting Officer*

*Acting Director of the United States Patent and Trademark Office*